US010336951B2

(12) United States Patent
Albert et al.

(10) Patent No.: US 10,336,951 B2
(45) Date of Patent: Jul. 2, 2019

(54) DESALTER EMULSION SEPARATION BY HYDROCARBON HEATING MEDIUM DIRECT VAPORIZATION

(71) Applicant: ExxonMobil Research and Engineering Company, Annandale, NJ (US)

(72) Inventors: Brian D. Albert, Fairfax, VA (US); Theodore Trent Trier, Billings, MT (US); Jose X. Simonetty, Kingwood, TX (US); Magaly A. Barroeta, Tomball, TX (US); Victor Alva, Everett, WA (US); Michael Louis Hergenrother, Kingwood, TX (US); Owen P. Jacobs, Plainfield, IL (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 16/164,192

(22) Filed: Oct. 18, 2018

(65) Prior Publication Data

US 2019/0048269 A1 Feb. 14, 2019

Related U.S. Application Data

(62) Division of application No. 14/467,110, filed on Aug. 25, 2014, now Pat. No. 10,119,080.

(60) Provisional application No. 61/882,358, filed on Sep. 25, 2013.

(51) Int. Cl.

| | |
|---|---|
| ***C10G 31/08*** | (2006.01) |
| ***C10G 31/06*** | (2006.01) |
| ***C10G 31/00*** | (2006.01) |
| ***C10G 33/00*** | (2006.01) |

(52) U.S. Cl.

CPC ..... *C10G 31/08* (2013.01); *C10G 31/06* (2013.01); *C10G 33/00* (2013.01)

(58) Field of Classification Search

CPC ..... C10G 31/06; C10G 31/08; C10G 33/00

See application file for complete search history.

(56) References Cited

U.S. PATENT DOCUMENTS

| | | | | |
|---|---|---|---|---|
| 3,798,153 A * | 3/1974 | Arndt | C10G 7/00 208/187 |
| 3,917,564 A | 11/1975 | Meyers | |
| 4,315,815 A | 2/1982 | Gearhart | |
| 4,722,781 A * | 2/1988 | Swartz | C10G 31/08 208/177 |
| 4,770,747 A | 9/1988 | Muller | |

(Continued)

*Primary Examiner* — Renee Robinson
*Assistant Examiner* — Derek N Mueller
(74) *Attorney, Agent, or Firm* — Glenn T. Barrett

(57) ABSTRACT

A petroleum desalting process in which the oil/water emulsion layer which forms in the desalter vessel between the settled water layer and the settled oil layer is separated into the oil and water components by contact with a heated high boiling hydrocarbon to break the emulsion and vaporize water from the emulsion in a flash drum. The vessel has an emulsion outlet for removing an emulsion stream from the emulsion layer and a conduit connecting the emulsion withdrawal port to an inlet of an optional settling drum to effect and initial separation into an oil-enriched phase and a water phase with the oil-enriched phase led to the flash drum.

10 Claims, 1 Drawing Sheet

(56) References Cited

U.S. PATENT DOCUMENTS

| | | | |
|---|---|---|---|
| 4,874,505 | A | 10/1989 | Bartilucci et al. |
| 4,938,876 | A | 7/1990 | Ohsol |
| 5,009,767 | A | 4/1991 | Bartilucci et al. |
| 5,882,506 | A | 3/1999 | Ohsol et al. |
| 5,948,242 | A | 9/1999 | Ohsol et al. |
| 2012/0024758 | A1 | 2/2012 | Love |

* cited by examiner

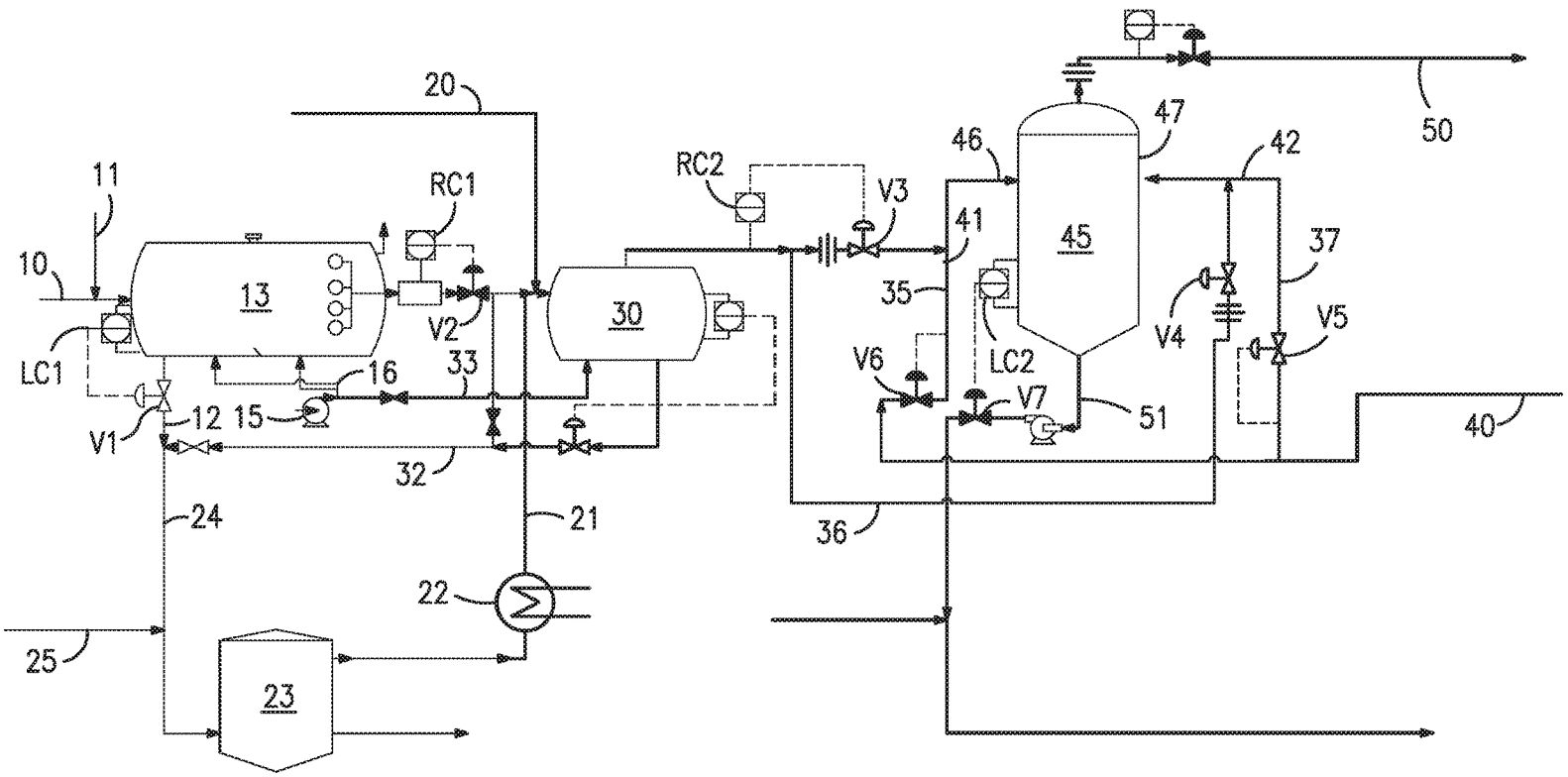
50
40
37
V5
42
V4
47
45
51
V7
LC2
46
41
35
V6
V3
36
RC2
30
21
20
RC1
V2
33
32
22
16
13
15
12
24
23
11
10
LC1
V1
25

DESALTER EMULSION SEPARATION BY HYDROCARBON HEATING MEDIUM DIRECT VAPORIZATION

CROSS REFERENCE TO RELATED APPLICATION

This application is a divisional application of U.S. patent application Ser. No. 14/467,100, filed on Aug. 25, 2014, which claims priority to U.S. Provisional Application No. 61/882,358, filed on Sep. 25, 2013.

FIELD OF THE INVENTION

This invention relates to petroleum desalters and their operation.

BACKGROUND OF THE INVENTION

Crude petroleum contains impurities which include water, salts in solution and solid particulate matter that may corrode and build up solid deposits in refinery units; these impurities must be removed from the crude oil before the oil can be processed in a refinery. The impurities are removed from the crude oil by a process known as "desalting", in which hot crude oil is mixed with water and a suitable demulsifying agent to form a water-in-oil emulsion which provides intimate contact between the oil and water so that the salts pass into solution in the water. The emulsion is then passed into a high voltage electrostatic field inside a closed separator vessel. The electrostatic field coalesces and breaks the emulsion into an oil continuous phase and a water continuous phase. The oil continuous phase rises to the top to form the upper layer in the desalter from where it is continuously drawn off while the water continuous phase (commonly called "brine") sinks to the bottom from where it is continuously removed. In addition, solids present in the crude will accumulate in the bottom of the desalter vessel. The desalter must be periodically jet washed to remove the accumulated solids such as clay, silt, sand, rust, and other debris by periodically recycling a portion of the desalter effluent water to agitate the accumulated solids so that they are washed out with the effluent water. These solids are then routed to the wastewater system. Similar equipment (or units) and procedures, except for the addition of water to the oil, are used in oil producing fields to dehydrate the oil before it is transported to a refinery.

During operation of such units, an emulsion phase of variable composition and thickness forms at the interface of the oil continuous phase and the water continuous phase in the unit. Certain crude oils contain natural surfactants in the crude oil (asphaltenes and resins) which tend to form a barrier around the water droplets in the emulsion, preventing coalescence and stabilizing the emulsion in the desalting vessel. Finely divided solid particles in the crude (<5 microns) may also act to stabilize the emulsion and it has been found that solids-stabilized emulsions present particular difficulties; clay fines such as those found in oils derived from oil sands are thought to be particularly effective in forming stable emulsions. This emulsion phase may become stable and persist in the desalting vessel. If this emulsion phase (commonly known as the "rag" layer) does stabilize and becomes too thick, the oil continuous phase will contain too much brine and the lower brine phase will contain unacceptable amounts of oil. In extreme cases it results in emulsion being withdrawn from the top or bottom of the unit. Oil entrainment in the water phase is a serious problem as it is environmentally impermissible and expensive to remedy outside the unit. Also, it is desirable to achieve maximum coalescence of any remaining oil droplets entrained in the water continuous phase and thereby ensure that the withdrawn water phase is substantially oil free by operating the unit with the water continuous phase to be as close as possible to the high voltage electrodes in the unit without resulting in shorting across the oil to the water. If, on the one hand, the emulsion phase gets too thick the dosage of the demulsifying agent must be increased; on the other hand, if the water continuous phase gets too high or too low, the water phase withdrawal valve at the bottom of the unit called a "dump valve" must be correspondingly opened or closed to the degree necessary to reposition the water phase to the desired level in the unit and for this purpose.

Processing crudes with high rag layer formation tendencies in current desalter configurations may cause poor desalting (salt removal) efficiency due to solids build up at the bottom of the vessel, and/or a solids stabilized rag layer leading to erratic level control and insufficient residence time for proper water/oil separation. Solids stabilized emulsion layers have become a major desalter operating concern, generating desalter upsets, increased preheat train fouling, and deteriorating quality of the brine effluent and disruption of the operation of the downstream wastewater treatment facilities.

Refinery sites which process high solids content crudes (characterized as containing more than 150 ppm inorganic solids) have the most pervasive problems with emulsion formation. Heavy crude oils and bitumens from Western Canada which contain elevated levels of small clay fines and other small solids are particularly prone to forming large volumes of highly stable emulsion. Examples of Western Canadian crude oils with emulsion forming tendencies include but are not limited to: Western Canadian Select (WCS), Cold Lake Blend (CLB), Access Western Blend, Albian Heavy and Seal Heavy.

The water content of the emulsion can range from 50 to 95% water with the balance being hydrocarbon (normally full range crude oil) and up to 5 weight percent inorganic solids. Precipitated asphaltenes, waxes and paraffins are also found at elevated levels in the emulsion (compared to the incoming crude oil) which combine with particulates (solids), to bind the mixture together forming a complex structure which is highly stable. Intractable emulsions of this kind comprising oil, water and solids make adequate separation and oil recovery difficult. Often, these emulsions arising from the desalter are periodically discarded as are other intractable emulsions and slop streams throughout the refinery. This results in expensive treating or handling procedures or pollution problems as well as the fact that useful crude oil is also lost with these emulsions and slop streams.

Emulsions must be separated into well-defined oil and water phases before they can be reintroduced to refinery process units (e.g. crude distillation, coker, etc.) or waste water treatment plant. These stable emulsions cannot be completely separated by heating and conventional gravity settling and require specialized separation equipment.

In most cases, complete separation of water from the oil is inhibited by the presence of an envelope of solid or semi-solid material in a thin-film layer around the surface of each individual water droplet. This material may be inorganic, for example as clay platelets, or silica or limestone particles, or it may be organic such as wax-like or bitumen-like particles. These inorganic and organic solids act as emulsion stabilizers. Furthermore, if the oil has a specific gravity approaching that of water and has a high viscosity, the difficulty of separating these types of oil emulsions is further compounded. The high viscosity greatly hampers the effectiveness of separation equipment. These stable emulsions cannot be completely separated by heating and conventional gravity settling and require specialized separation equipment.

U.S. Pat. No. 4,938,876 describes a process in which emulsions are rendered more amenable to gravitational and cyclonic separation by causing a portion of the normally water dispersed phase to flash into vapor by suddenly reducing pressure on the emulsion which has been heated by direct contact with superheated water and/or steam. The flashing action accompanying the reduction in pressure is stated to be extremely powerful even when only a small fraction, 10 percent by volume or less, of the dispersed phase is vaporized. The envelope around each droplet is thus shattered so the dispersed phase can be coalesced and separated by gravity, or enhanced gravity forces, when there is a sufficient divergence of specific gravity and a low viscosity. Suitable anti-emulsion chemicals are often added to prevent re-emulsification.

U.S. Pat. No. 5,882,506 (Ohsol) describes method for treating desalter rag layer emulsions, for the recovery of processable oil values by adding a sufficient amount of a light hydrocarbon diluent to the emulsion to lower its overall viscosity and to reduce the specific gravity of the oil phase. The diluted emulsions are subjected to flashing at emulsion-breaking conditions after which the oil is recovered from the various streams created in the flashing steps.

One of the most common industry practice is to separate the stable emulsion into separate water, oil and solids phases using 3-phase centrifuges (decanter centrifuges). The centrifuge separation is often enhanced with the use of chemical emulsion breakers, heating and/or depressuring the emulsion to facilitate the process. US 2012/0024758 (Love) proposes a technique in which the emulsion "rag" layer is withdrawn from the separator vessel at a rate that maintains the height of the emulsion layer approximately constant so as to permit withdrawal of the rag layer at a fixed level from the vessel. The withdrawn emulsion is then processed outside the vessel through a stacked disk centrifuge.

Currently practiced centrifuge separation approach has numerous reliability and cost drawbacks centering on the separation of the oil and water phases before they can be reintroduced to refinery process units (e.g. crude distillation, coker, etc.) or the waste water treatment plant. Problem areas include:

- High cost associated with processing emulsion stream typically through a third party reprocessor outside of the refinery's direct operational control.
- Historically poor mechanical reliability and time on stream for the centrifuge separation process.
- The need to mitigate or recover vapor emissions as the emulsion is processed. in the centrifuge. Heating of the emulsion is often necessary to achieve the separation which further increases the volume of vapor emissions to handle.
- Large volumes of recovered solids which must be disposed of as hazardous waste or further processed to allow their disposal by the Mobil Oil Sludge Coking Process in the coker[1].

[1]The Mobil Oil Sludge Conversion process, or the MOSC process is described in U.S. Pat. Nos. 3,917,564, 4,874,505 and 5,009,767.

- Batch operation which requires storage for separated oil, water and solids.
- Frequent recycling or reprocessing of the material to achieve complete phase separation.

Recovery of the separated oil phase often requires reintroduction to the crude preheat upstream of the desalter where the emulsion was originally formed. The returns may contain contaminants which tend to reform emulsion.

Co-pending U.S. Provisional Patent Application Ser. No. 61/774,957, filed 8 Mar. 2013 (EM Family No. 2013EM063), describes an improved mode of desalter operation in which provides for withdrawal of a portion of the emulsion layer from the desalter vessel through one or more external withdrawal headers according to the thickness and position of the emulsion layer with the selected withdrawal header(s) being controlled by sensors monitoring the position and thickness of the emulsion layer. The withdrawn emulsion layer is then routed as such or with the desalter water effluent to a settling tank or directly to another unit for separation and reprocessing.

Co-pending U.S. Provisional Patent Application Ser. No. 61/828,963, filed 30 May 2013 (EM Family No. 2013EM170), describes an improved mode of desalter operation in which provides for withdrawal of a portion of the emulsion layer from the desalter vessel for treating the emulsion layer withdrawn from the desalter vessel in order to separate it into its oil and water components along with any solids brought along with it. This treatment comprises diluting the withdrawn emulsion with added water or oil to destabilize the emulsion and permit its subsequent separation. The desalting method is operated by forming a settled water layer containing the dissolved salts with a settled supernatant, desalted oil layer and an intervening emulsion layer formed from the oil and the water. A portion of the emulsion is withdrawn through one or more withdrawal ports or headers and diluted with an added fluid, typically water or an added hydrocarbon feedstock, to destabilize the emulsion which is then separated, optionally with the aid of an electrostatic precipitator in a separator vessel which itself may be a desalter type vessel operating with a high voltage electric filed to facilitate the separation.

SUMMARY OF THE INVENTION

We have now developed a petroleum desalting process in which the oil/water emulsion layer which forms in the desalter vessel between the settled oil and water layers is separated into the oil and water components by direct contact with a heated, high boiling hydrocarbon acting as a heating medium to transfer heat from the heating medium to the emulsion. This has the effect of breaking the emulsion and then at least partly vaporizing the water content of the emulsion in a flash drum downstream from the desalter vessel. The desalter vessel used for the process has an emulsion outlet for removing an emulsion stream from the emulsion layer and this outlet may be connected to the inlet of an optional settling drum to effect an initial separation into an oil-enriched phase and a water phase with the oil-enriched phase led to the flash drum following contact with the heating medium. The preferred heating medium is an atmospheric or vacuum resid, both of which have the advantage of being readily available and of not introducing additional light hydrocarbon vapors into the flash drum along with the water vaporized from the emulsion.

According to the present invention, the petroleum desalting process comprises the essential steps of mixing a crude oil to be desalted with desalting water and passing the mixture of oil and water to a desalter vessel to form (i) a settled water layer containing salts dissolved from the oil in the lower portion of the vessel, (ii) a settled supernatant, desalted oil layer in the upper portion of the vessel and (iii)

an emulsion layer formed from the oil and the water and comprising emulsified oil and water, between the settled water layer and the settled oil layer. A stream of the emulsion from the emulsion layer is removed from the desalter vessel and is subjected to be broken into its oil and water component streams by contact with a heated high boiling hydrocarbon, preferably a heated residual oil, which not only breaks the emulsion but also vaporize water from the emulsion. An initial settling operation can be effected on the emulsion withdrawn from the desalter vessel to form a relatively oil-enriched emulsion which is then contacted with the hydrocarbon heating medium and led to a flash drum where the emulsion breaking and vaporization is carried out.

In operation, the desalting is carried out in a desalting unit by mixing a crude oil to be desalted with desalting water and passing the mixture of oil and water to the desalter vessel in which the emulsion layer formed from the oil and the water forms between the settled water layer and the settled oil layer; water is removed from the water layer through a water outlet conduit at the bottom of the vessel and desalted oil is removed from the oil layer through an oil outlet conduit at the top of the vessel. An emulsion outlet for removing an emulsion stream from the emulsion layer is provided in the vessel and this is connected to an inlet of a flash drum by a conduit with an inlet where the emulsion is mixed with the hydrocarbon heating medium used to break the emulsion and to vaporize the water from the broken emulsion in the flash drum. The optional settling drum may be interposed between the emulsion outlet of the desalter vessel and the inlet used for the heated heavy oil which provides the heat necessary for breaking the emulsion and vaporizing the water. Additional heat may be supplied to the emulsion stream by interposing a heat exchanger in the emulsion conduit before the inlet for the hydrocarbon heating medium; this heat exchanger may be fed with waste heat from another refinery process.

DRAWINGS

In the accompanying drawings the single FIGURE is a simplified diagram of a petroleum crude desalter unit with a desalter vessel and an initial emulsion settling drum followed by a feed inlet for the hydrocarbon heating medium and a flash drum in which the emulsion water is vaporized.

DETAILED DESCRIPTION

In its most common form with electrostatically induced separation in the settler vessel, the desalting process first mixes the crude or crude blend with water using a mixing valve or other equivalent device to produce an oil/water emulsion to ensure good contact between the oil and the water to favor removal of soluble salts by the water as well as promoting separation of separated solids. The resulting emulsion is then exposed to an electric field to initiate the coalescence of the water droplets inside of the desalter vessel or separator. With time, the feed emulsion separates into an aqueous phase, an oil phase, and a solids phase which settles to the bottom of the vessel and is withdrawn there. The aqueous phase contains salts and suspended solids derived from the crude oil. The oil phase is recovered as desalted crude, from the top of the desalter vessel and normally is sent to an atmospheric distillation unit for further processing into feedstocks for motor fuel, lubricants, asphalt and other ultimate products and uses such as petrochemical production. The aqueous phase is further processed in a water treatment plant. Depending upon the crude or combination of crudes and the mixing intensity, an excessive stable emulsion (rag) layer may form in between the oil phase and the aqueous phase. Typically, this emulsion layer which contains 20 to 70% v/v water accumulates until it becomes too close to the electrodes of the desalter. This uncontrolled growth, if continued, may ultimately short out the electrodes, resulting in a complete shutdown of the desalter with a loss of oil and water separation. If, simultaneously the emulsion layer is allowed to grow downwards, an unacceptable oil contamination of the aqueous phase may ensue, exceeding the capability of the associated water treatment plant to process the brine to an acceptable environmental quality. Prudent operating practice therefore calls for the water level to be maintained at a substantially constant level in the vessel.

Conventionally, the practice is to process the crude with a single stage desalter. Some units operate with two separator vessels in series where the water is cascaded counter currently to the crude to maximize salt removal. The separator vessel typically uses gravity and an imposed electric field to coalesce and separate oil and water emulsions into the oil and the wastewater effluent. Separators are available from a variety of commercial sources.

The wash water used to treat the crude oil may be derived from various sources and the water itself may be, for example, recycled refinery water, recirculated wastewater, clarified water, purified wastewater, sour water stripper bottoms, overhead condensate, boiler feed water, clarified river water or from other water sources or combinations of water sources. Salts in water are measured in parts per thousand by weight (ppt) and range from fresh water (<0.5 ppt), brackish water (0.5-30 ppt), saline water (30-50 ppt) to brine (over 50 ppt). Although deionized water may be used to favor exchange of salt from the crude into the aqueous solution, de-ionized water is not normally required to desalt crude oil feedstocks although it may be mixed with recirculated water from the desalter to achieve a specific ionic content in either the water before emulsification or to achieve a specific ionic strength in the final emulsified product. Wash water rates may be between approximately 5% and approximately 7% by volume of the total crude charge, but may be higher or lower dependent upon the crude oil source and quality. Frequently, a variety of water sources are mixed as determined by cost requirements, supply, salt content of the water, salt content of the crude, and other factors specific to the desalting conditions such as the size of the separator and the degree of desalting required.

The emulsion layer which forms in the desalter vessel is removed from the vessel for processing to break the emulsion into its oil and water components. Preferably, all or part of the withdrawn emulsion layer is taken to a settler drum in which an initial resolution can be effected prior to contact with the heated heavy oil. The initial separation can be assisted by the injection of an additive, if desired, e.g. by the addition of demulsifiers or other means. Additional water may be added to the settler if this will improve resolution of the withdrawn emulsion.

Depending upon the crude or combination of crudes and the mixing intensity, the emulsion layer forms between the oil phase and the aqueous phase in the desalter vessel. Crudes with high solids contents present a particularly intractable problem since the presence of the solids, often with particle sizes under 5 microns, may act to stabilize the emulsion, leading to a progressive increase in the depth of the rag layer with the stability of the emulsion varying inversely with decreasing particle size. The present invention is especially useful in its application to challenged crudes containing high levels of solids, typically over 5,000 ppmw but it may also be applied to benefit the desalting of high asphaltene content crudes which also tend to stabilize the emulsion layer in the desalter.

The emulsion phase from the desalter contains a high concentration of oil, residual water, suspended solids and salts which, in a typical example, might be approximately 70% v/v water, 30% v/v oil, with 5000-8000 pounds per thousand barrels (PTB) (about 14 to 23 g/l.) solids, and 200-400 PTB (about 570 to 1100 mg/l.) salts. The aqueous phase contains salts from the crude oil. As an initial step in the separation, an additive, typically a demulsifier and/or polymer, can be injected into the emulsion to induce settling and so enhance the separation of free water from the emulsion and the oily solids phase. The emulsion is then passed to a settling drum to permit the initial separation to take place; the aqueous phase is removed from the bottom of the settling drum and treated as sour water. The supernatant, oil-enriched emulsion phase is removed from the drum and mixed with the hot hydrocarbon heating medium to effect a heat transfer from the heating medium which acts to vaporize any remaining water in the emulsion in the flash drum and effect a separation from the oil and oily solids. The drum vapors can be used as process stripping steam in the atmospheric distillation unit, vacuum stripping unit or other application to minimize total steam usage. The flash drum bottoms stream is sent to another unit for processing or reintroduced into the crude unit. Processing in another unit is preferred in order to avoid reintroducing solids or other components which favor emulsion formation. The flash drum bottoms can be treated with caustic injection to convert salts to more stable sodium chloride salts which will minimize the overhead chlorides in downstream process towers.

The initial separation under gravity in the settling drum is aided by the use of higher temperatures and although the emulsion from the desalter vessel is already at a temperature sufficiently high, e.g. 110 to 145° C. (about 230 to 290° F.) to favor settling, it is desirable to add a heated emulsion from an external source or sources, e.g. from refinery rundowns, crude feed operations, waste water treatment tankage, prior to separation in the settling drum. If emulsion from other sources is added, it should be heated to a comparable temperature or higher, e.g. to about 140 or 150° C. to facilitate gravity separation when a significant volume of water can be separated. Higher temperatures are favorable to separation, from about 90 to 175° C. (about 195 to 350° F.). The full emulsion stream is then sent to a settling drum where sufficient residence time is allowed for free water to coalesce separating into an aqueous phase and a partially dewatered, oil-enriched emulsion phase. Testing has shown that each emulsion has a threshold temperature above which effective settling occurs and accordingly, the optimal temperature for the settling should be determined empirically and conditions adjusted accordingly.

The denser, separated water phase (brine) is removed as bottoms from the settling drum and returned to the desalter or sent to refinery water treatment units. The oily phase is then contacted with the hot hydrocarbon heating medium and sent to the flash drum where the remaining water vaporizes from the oily solids and is removed as overhead along with incidental light hydrocarbon vaporized from the oil in the emulsion by equilibrium with the water The drum vapors can then be used as process stripping steam in the atmospheric distillation unit or other similar application, thereby minimizing total steam usage. The flash drum bottoms stream is sent to another unit for processing or reintroduced into the crude unit. The flash drum bottoms can be treated with caustic injection to convert salts to more stable sodium chloride salts which will minimize the overhead chlorides in downstream process towers.

The process preferably utilizes vacuum residuum as the direct vaporization heating medium but other high boiling (IBP at least 225° C. (440° F.) and preferably at least 345° C. (650° F.)) hydrocarbons such as atmospheric residuum, desalted crude, vacuum gas oil, atmospheric gas oil may also be used, consistent with the desire to minimize incremental hydrocarbon recycle to upstream units such as the atmospheric tower. When lower boiling heating media containing light hydrocarbons are used, e.g. desalted crude, the light ends will be vaporized in the flash drum along with the water; in this case, the drum vapors can be sent to a crude unit preflash tower or drum. The basic process configuration will be as described above with the alternative hydrocarbon heating medium utilized to vaporize the emulsion water content. The final disposition of the combined flashed oil stream (heating medium plus emulsion oil) will vary depending on the hydrocarbon type used in the process so that the stream will be sent to the refinery unit appropriate to its composition; when atmospheric or vacuum resid is used, for instance, the coker would be the appropriate unit, particularly since it has the capability to accommodate and dispose of the solids from the emulsion.

The bulk temperature of the hydrocarbon heating medium is typically from 175 to 375° C. (about 350 to 700° F.), preferably 260 to 350° C. (about 500 to 660° F.), when contacted with the emulsion stream with the pressure being less than the emulsion pressure in order to prevent backflow into the settler; pressures will typically be at least 500 kPag (72 psig) and more commonly at least 850 kPag (about 123 psig), e.g. 1000 kPag (about 145 psig). The emulsion temperature will depend, of course, on the temperature at which the desalter vessel is operated and the temperature of any imported emulsion along with conditions in the settling drum. Typical emulsion stream temperatures will be from 90 to 150° C. (about 195 to 300° F.) with pressure sufficient to maintain liquid phase conditions, e.g. about 700 to 1400 kPag (about 100 to 200 psig). The ratio of the heavy oil heating medium to the emulsion must be determined empirically depending on the water content of the emulsion, the respective temperatures of the emulsion and the heating medium and the heat requirements of the emulsion breaking/flashing step. In general, a volumetric excess of the heating medium will be used to ensure complete vaporization of the water; as the preferred heating streams are typically lower value residual streams, the use of the excess will not involve a significant economic penalty. Typically, the ratio of emulsion to heating medium will be from 3:1 to 20:1 v/v, and more commonly from 5:1 to 10:1 v/v.

In the FIGURE, the crude feed to the desalter enters by way of line 10 with makeup wash water entering through line 11 and recycled water through line 12 before the mixture passes into the desalter vessel 13. A mudwash circuit is provided by pump 15 and line 16 in the conventional manner. Level controller LC1 and its associated control valve V1 regulates the water rate relative to oil feed rate to maintain the desired interface between the layers in the settler. The emulsion layer is withdrawn from the settler through one or more of the multiple withdrawal ports which may be activated by the method described in co-pending U.S. Provisional Patent Application Ser. No. 61/774,957, filed 8 Mar. 2013 (EM Family No. 2013EM063), with the selected withdrawal header(s) controlled by sensors monitoring the position and thickness of the emulsion layer.

The withdrawn emulsion may be mixed with any demulsifier and/or polymer additive entering by way of line 20 in order to favor separation of the oil and water phases from the emulsion. The withdrawal rate from the desalter is regulated by flow rate controller RC1 with its associated control valve V2. Emulsion from external sources enters through line 21 after passing through heat exchanger 22 to bring it to a requisite high temperature, e.g. 50 to 150° C. (about 120 to 280° F.). Tankage 23 which receives brine from the desalter by way of line 24 and other brine through line 25 may provide emulsion from the higher level of the tank. The emulsion from the desalter vessel with any added external emulsion and additive pass into settling drum 30 where an initial separation of free water from the emulsion takes place. Free water (brine) is withdrawn from the bottom of the drum and recycled to desalter 13 through line 32; some water may be used for the mudwash by way of line 33. The oil-enriched phase is withdrawn from the top of the settling drum and passed via flow rate controller RC2 and valve V3 to be mixed with hot resid or other hydrocarbon feed entering by way of line 35 while a second portion of the emulsion is taken via line 36 to mix with hot resid or other feed from line 37 with the flow rate in line 36 under the control of valve V4. The incoming hot resid or other feed functioning as the heating medium enters the unit by way of line 40 and is divided into the flow through line 37 and line 35 with the relative flow rates regulated by valves V5 and V6.

The mixing points where the emulsion is introduced into the stream of hot oil are shown as 41, 42 in schematic form, located along the line between the settling drum and the flash drum intermediate the outlet of the settling drum and the inlet(s) to flash drum 45. In order to ensure complete vaporization of the water, it is preferred to introduce the emulsion into the incoming stream of excess hot oil which enters at the higher flow rate to provide the desired excess. Preferably, a quill type injector or a small tapered pipe is used to feed the emulsion into the center of the flowing stream of hot heating medium in the vaporization line. After mixing the emulsion with the hot oil, the mixture is preferably fed along the line leading to flash drum 45 for a sufficient distance to allow for homogenization of the mixture which will be assisted by partial vaporization of the emulsion. Preferably, the lines should be vertical after the mix point with the quill or injection pipe directing the incoming emulsion in an upward direction into the flowing hydrocarbon; good homogenization of the emulsion/hydrocarbon mixture has been found with at least 10 and preferably 20 or even more, e.g. 25, pipe diameters of line length downstream of the mix point.

The emulsion/oil mixture enters flash drum 45 through two opposed inlets 46, 47 at opposite sides of a drum diameter. The mixture is preferably introduced through tangential feed horns with peripheral annular rings of the type commonly used in vacuum distillation towers to ensure full vaporization of the water. Feed horns of this type are shown, for example, in U.S. Pat. Nos. 4,770,747 and 4,315,815 (with guide vanes). The steam and other vapors pass out of flash drum 45 as overhead and are taken through line 50 to utilization as described above. Mist eliminators, e.g vane type eliminators, are preferably used in the upper portion of the flash drum to reduce liquid carry over. The liquid oil phase is removed as bottoms through line 51 with the effluent rate being controlled in response to the level in the drum by level controller LC2 and valve V7. In order to preclude solids accumulation in the flash drum, a conical bottom configuration as shown in desirable to permit continuous withdrawal of the solids embedded in the oil phase. The oil withdrawn from the bottom of flash drum 45 can be passed to normal utilization in other process units in the refinery, e.g. the coker, as noted above.

Another variation for heating of the emulsion to facilitate emulsion and water separation is the use of a heat exchanger or kettle reboiler. The process flow is similar to that shown in the FIGURE but the injection of a higher temperature hydrocarbon stream to achieve flash drum conditions is omitted in favor of heating the emulsion by means of a heat exchanger or kettle reboiler positioned in the line between settling drum 30 and flash drum 45 to bring the emulsion to flash drum conditions and supply the heat required to allow flashing and separation of the water and some light hydrocarbons in the flash drum.

A hybrid to the heating options outlined is to utilize both a heat exchanger or kettle reboiler in the line between the settling drum and the flash drum in addition to the hot hydrocarbon heating medium to attain the conditions required for water separation from the emulsion in the flash drum. The benefits of this modification allow the stream of heating medium to provide some heating with the remainder being supplied by a waste heat stream through the use of the heat exchanger.

In some cases it may be advantageous to route the vapors from the flash drum overhead to a separate condenser and settling drum. The condensing system would be similar to those currently used on heavy hydrocarbon fractionator tower overhead systems. The vapors will be cooled with exchangers and the condensed water and hydrocarbon then separated in a three-phase separator drum. The condensed water, liquid hydrocarbon, and non-condensable vapor are then returned to crude distillation or coker units for processing with other similar streams in the unit.

Emulsions that are tightly bound or require less brine water separation may not require the use of a settling drum. The process flow for this application would be very similar to the process flow shown in the FIGURE but, there is no brine water separation from the emulsion streams prior to the heating and flashing steps of the process. Any brine water in these emulsion streams will require additional heating duty for the water that is not separated because flash drum thermodynamic conditions need to be maintained for effective separation of the emulsion.

ADDITIONAL EMBODIMENTS

Embodiment 1

A petroleum desalting process which comprises: mixing a crude oil to be desalted with desalting water and passing the mixture of oil and water to a desalter vessel to form (i) a settled water layer containing salts dissolved from the oil in the lower portion of the vessel, (ii) a settled supernatant, desalted oil layer in the upper portion of the vessel and (iii) an emulsion layer formed from the oil and the water and comprising emulsified oil and water, between the settled water layer and the settled oil layer, removing a stream of the emulsion from the emulsion layer, contacting the removed emulsion stream with a hydrocarbon heating medium to transfer heat from the heating medium to the emulsion to break the emulsion and vaporize water from the emulsion.

Embodiment 2

A desalting process according to Embodiment 1 in which the hydrocarbon heating medium is at a bulk temperature of 175 to 375° C. when contacted with the emulsion stream.

Embodiment 3

A desalting process according to Embodiment 2 in which the hydrocarbon heating medium is at a bulk temperature of 260 to 350° C. when contacted with the emulsion stream.

Embodiment 4

A desalting process according to anyone of Embodiments 1-3 in which the hydrocarbon heating medium has an initial boiling point of at least 225° C.

Embodiment 5

A desalting process according to anyone of Embodiments 1-4 in which the hydrocarbon heating medium has an initial boiling point of at least 345° C.

Embodiment 6

A desalting process according to Embodiment 5 in which the hydrocarbon heating medium comprises a vacuum residual stream.

Embodiment 7

A desalting process according to anyone of Embodiments 1-6 in which the stream of emulsion withdrawn from the desalter vessel is withdrawn through at least one of a plurality of vertically separated withdrawal ports in the desalter vessel.

Embodiment 8

A desalting process according to anyone of Embodiments 1-6 in which the withdrawn emulsion stream is settled to effect a partial separation of water and oil from the emulsion to form an oil-enriched stream and a water stream with the oil-enriched stream passed to the flash drum.

Embodiment 9

A desalting process according to Embodiment 8 in which the oil-enriched stream is heated in a heat exchanger before mixing with the heated high boiling hydrocarbon.

Embodiment 10

A desalting process according to anyone of Embodiments 1-9 in which a demulsifying additive is added to the emulsion stream removed from the desalter vessel.

Embodiment 11

A petroleum desalter which comprises: a desalter vessel having a feed inlet for admitting a mixture of crude oil to be desalted with desalting water to form (i) a settled water layer containing salts dissolved from the oil in the lower portion of the vessel, (ii) a settled supernatant desalted oil layer in the upper portion of the vessel and (iii) an emulsion layer formed from the oil and the water and comprising oil and water formed between the settled water layer and the settled oil layer, a water outlet conduit at the bottom of the vessel for removing water from the water layer, an oil outlet conduit at the top of the vessel for removing desalted oil from the oil layer, at least one emulsion outlet for removing an emulsion stream from the emulsion layer, a conduit connecting the emulsion outlet to at least one inlet of a flash drum, a mixing point located along the conduit for admitting the withdrawn emulsion to a stream of a hydrocarbon heating medium to transfer heat from the heating medium to the emulsion, to break the emulsion and vaporize water from the broken emulsion in the flash drum.

Embodiment 12

A petroleum desalter which comprises: a desalter vessel having a feed inlet for admitting a mixture of crude oil to be desalted with desalting water to form (i) a settled water layer containing salts dissolved from the oil in the lower portion of the vessel, (ii) a settled supernatant desalted oil layer in the upper portion of the vessel and (iii) an emulsion layer formed from the oil and the water and comprising oil and water formed between the settled water layer and the settled oil layer, a water outlet conduit at the bottom of the vessel for removing water from the water layer, an oil outlet conduit at the top of the desalter vessel for removing desalted oil from the oil layer, at least one emulsion outlet for removing an emulsion stream from the emulsion layer, a conduit connecting the emulsion withdrawal port to a settling drum having an upper outlet and a lower outlet, to settle the emulsion and remove water from the emulsion, to form an oil-enriched emulsion stream to be withdrawn from the settling drum through its upper outlet and passed to a flash drum, a second conduit connecting the upper outlet of the settling drum to at least one inlet of the flash drum, an inlet located along the second conduit for admitting a stream of the oil-enriched emulsion to the hydrocarbon heating medium to transfer heat from the heating medium to the emulsion, to break the emulsion and vaporize water from the broken emulsion in the flash drum.

Embodiment 13

A desalter according to Embodiments 11 or 12 in which the desalter vessel has a plurality of vertically spaced emulsion withdrawal points connected to the emulsion withdrawal port.

Embodiment 14

A desalter according to Embodiments 11 or 12 in which the emulsion outlet of the desalter vessel is connected to a settling drum having an upper outlet and a lower outlet, to settle the emulsion and remove water from the emulsion, to form an oil-enriched stream to be withdrawn from the settling drum through its upper outlet and passed to the flash drum.

Embodiment 15

A desalter according to Embodiments 11 or 12 which includes a heat exchanger in the conduit connecting the emulsion withdrawal port to the flash drum.

Embodiment 16

A desalter according to Embodiments 11 or 12 in which the mixing point for admitting the withdrawn emulsion into stream of hydrocarbon heating medium the comprises a quill injector for the emulsion.

Embodiment 17

A desalter according to Embodiments 11 or 12 in which the conduit connecting the emulsion withdrawal port to the inlet of the flash drum is branched to provide two branch conduits for the emulsion feed, respectively connected to two flash drum inlets.

Embodiment 18

A desalter according to Embodiment 17 in which each branch conduit has a tangential feed horn in the flash drum.

Embodiment 19

A desalter according to Embodiment 12 in which the inlet along the second conduit for admitting the stream of oil-enriched emulsion to the hydrocarbon heating medium comprises a quill injector for the emulsion.

Embodiment 20

A desalter according to Embodiments 12 or 19 in which the conduit connecting the emulsion withdrawal port to the inlet of the flash drum is branched to provide two branch conduits for the emulsion feed, respectively connected to two flash drum inlets.

Embodiment 21

A desalter according to Embodiment 20 in which each branch conduit has a tangential feed horn in the flash drum.

Embodiment 22

A desalter according to Embodiments 12, 19, 20 or 21 in which the inlet along the second conduit for admitting the stream of oil-enriched emulsion to the hydrocarbon heating medium comprises a quill injector for the emulsion feeding vertically into a vertically oriented portion of the conduit.

Embodiment 23

A desalter according to Embodiment 22 in which the inlet along the second conduit for admitting the stream oil enriched emulsion to the hydrocarbon heating medium comprises a quill injector for the emulsion feeding vertically into a vertically oriented portion of the conduit at least 20 conduit diameters long in vertical extent.

The main benefits of the present system and its operation system are as follows:

- Desalter operation is improved by not reprocessing refinery emulsion in the system
- Emulsion water is reused in the refinery steam system with the objective of reducing energy use and avoiding increased sour water processing to wastewater treatment
- The capability of processing challenged crudes with high solids and other emulsion forming contaminants is improved while minimizing chemical use
- Energy requirements and reliability concerns of reprocessing emulsion water, salts, solids and oil are improved
- A continuous and more reliable process than current alternatives and completely under the operational control of the operating refinery
- Light hydrocarbons or other contaminants in the emulsion are sent to the crude unit where they can be separated and recovered, avoiding the need for additional facilities to recover or neutralize/destroy the compounds.

The invention claimed is:

1. A petroleum desalting process which comprises:

mixing a crude oil to be desalted with desalting water and passing the mixture of oil and water to a desalter vessel to form (i) a settled water layer containing salts dissolved from the oil in the lower portion of the vessel, (ii) a settled supernatant, desalted oil layer in the upper portion of the vessel and (iii) an emulsion layer formed from the oil and the water and comprising emulsified oil and water, between the settled water layer and the settled oil layer, removing a stream of the emulsion from the emulsion layer, contacting the removed emulsion stream with a hydrocarbon heating medium to transfer heat from the heating medium to the emulsion to break the emulsion and vaporize water from the emulsion.

2. A desalting process according to claim 1 in which the hydrocarbon heating medium is at a bulk temperature of 175 to 375° C. when contacted with the emulsion stream.

3. A desalting process according to claim 1 in which the hydrocarbon heating medium is at a bulk temperature of 260 to 350° C. when contacted with the emulsion stream.

4. A desalting process according to claim 1 in which the hydrocarbon heating medium has an initial boiling point of at least 225° C.

5. A desalting process according to claim 1 in which the hydrocarbon heating medium has an initial boiling point of at least 345° C.

6. A desalting process according to claim 1 in which the hydrocarbon heating medium comprises a vacuum residual stream.

7. A desalting process according to claim 1 in which the stream of emulsion withdrawn from the desalter vessel is withdrawn through at least one of a plurality of vertically separated withdrawal ports in the desalter vessel.

8. A desalting process according to claim 1 in which the withdrawn emulsion stream is settled to effect a partial separation of water and oil from the emulsion to form an oil-enriched stream and a water stream, wherein the oil-enriched stream is passed to a flash drum.

9. A desalting process according to claim 8 in which the oil-enriched stream is heated in a heat exchanger before mixing with a heated high boiling hydrocarbon.

10. A desalting process according to claim 1 in which a demulsifying additive is added to the emulsion stream removed from the desalter vessel.

* * * * *